United States Patent [19]

Harada

[11] Patent Number: 4,693,689

[45] Date of Patent: Sep. 15, 1987

[54] CONTROLLING GEAR FOR OUTBOARD ENGINE

[75] Inventor: Norimichi Harada, Iwata, Japan

[73] Assignee: Sanshin Kogyo Kabushiki Kaisha, Japan

[21] Appl. No.: 846,468

[22] Filed: Mar. 28, 1986

Related U.S. Application Data

[63] Continuation of Ser. No. 671,733, Nov. 15, 1984, abandoned.

[30] Foreign Application Priority Data

Nov. 30, 1983 [JP] Japan ..... 58-224478

[51] Int. Cl.[4] ..... B63H 21/26

[52] U.S. Cl. ..... 440/51; 440/62; 440/87

[58] Field of Search ..... 440/51, 62, 86, 87; 74/480 B

[56] References Cited

U.S. PATENT DOCUMENTS

| | | | |
|---|---|---|---|
| 2,776,579 | 1/1957 | Nichel, Jr. | 440/87 X |
| 2,993,464 | 7/1961 | Conover | 115/18 |
| 3,559,612 | 2/1971 | Patterson | 440/62 |
| 3,943,878 | 3/1976 | Kirkwood et al. | 114/144 R |
| 4,318,701 | 3/1982 | Kirkwood et al. | 440/51 |
| 4,323,353 | 4/1982 | Kirkwood | 440/63 |
| 4,349,341 | 9/1982 | Morgan et al. | 440/51 |
| 4,362,515 | 12/1982 | Ginnow | 440/62 |
| 4,416,636 | 11/1983 | Boda | 440/51 |
| 4,496,326 | 1/1985 | Boda | 440/62 |

FOREIGN PATENT DOCUMENTS

| | | |
|---|---|---|
| 56-160297 | 12/1981 | Japan . |
| 58-89494 | 5/1983 | Japan . |
| 58-149892 | 9/1983 | Japan . |

*Primary Examiner*—Sherman D. Basinger
*Attorney, Agent, or Firm*—Ernest A. Beutler

[57] ABSTRACT

An outboard motor embodying an improved throttle and trim tab control mechanism. A trim tab is pivotally supported by the outboard motor for assisting in its steering operation. The trim tab is operated by means of a pair of flexible transmitters that are affixed, at their upper ends, to extend in a generally longitudinal direction and which are operated from a drum by means of a lost motion connection that is operative in response to movement of the steering lever relative to the outboard motor. The steering lever is further supported for rotation and is operatively connected to the engine throttle for controlling its throttle in response to rotation of the control lever.

5 Claims, 7 Drawing Figures

CONTROLLING GEAR FOR OUTBOARD ENGINE

This application is a continuation of application Ser. No. 671,733, filed Nov. 15, 1984 and now abandoned.

BACKGROUND OF THE INVENTION

This invention relates to a controlling gear for outboard engines and more particularly to an improved steering arrangement for a marine drive.

In a marine drive such as an outboard motor, it is well known that the associated watercraft is steered by rotating the outboard drive about a vertically extending steering axis. The force required to so steer the outboard drive can, in many instances, be quite large. This is particularly true when larger horsepower units are considered. In order to assist in such steering movement, it has been proposed to employ a trim tab that is mounted rearwardly on the outboard drive and which is steered in an opposite direction so as to generate a hydrodynamic force that will assist in the steering of the outboard drive. Such an arrangement is shown in U.S. Pat. No. 4,349,341, entitled "Vane Steering System For Marine Drives", issued Sep. 14, 1982 in the name of Edward J. Morgan et al.

As shown in that patent, there is an arrangement interconnected between the steering lever and the trim tab that employs a lost motion connection and the movement is transmitted to the trim tab by means of flexible transmitters. Other devices which operate in a similar manner have employed linkage systems and/or electrically operated motors for rotating the trim tab. The use of flexible transmitters has the advantage of simplicity, low cost and ease of installation. However, the flexible transmitting arrangement shown in the aforenoted patent is constructed in such a way that the ends of the flexible transmitters which are connected to the steering lever extend perpendicularly to the longitudinal axis of the outboard drive. As such, they can extend the width of this portion of the outboard drive since the flexible transmitters cannot be bent through too small a radius. This is not only unsightly but places the transmitters in an area where they can be damaged or may obstruct the operator's ability to reach components of the outboard drive which must be serviced.

It is, therefore, a principal object of this invention to provide an improved and simplified controlling arrangement for an outboard drive.

It is a still further object of this invention to provide an improved and simplified device for assisting steering of an outboard drive.

It is a yet further object of this invention to provide a steering arrangement for an outboard drive that is compact in nature.

The arrangement shown in the aforenoted patent is primarily adapted for use with remote steering mechanism. However, there is an advantage in the use of such a steering arrangement even when the motor is steered by a tiller. In addition to steering by the tiller, many outboard motors also employ a rotatable tiller that is operative to control the throttle of the engine for the motor. However, with the arrangement as shown in the aforenoted patent, such is not possible because of the design and costruction of the trim tab operating mechanism.

It is, therefore, a still further object of this invention to provide an improved arrangement for steering and controlling the speed of an outboard motor.

SUMMARY OF THE INVENTION

A first feature of this invention is adapted to be embodied in a steering arrangement for a marine outboard drive adapted to be fixed to the transom of an associated watercraft for steering movement about a generally vertically extending steering axis and which carries propulsion means at its lower end. A trim tab is pivotally carried by the outboard drive about an axis that is parallel to the steering axis and which is adapted to be submerged in operation. A steering lever is operatively connected to the outboard drive for controlling the steering movement about the steering axis. In accordance with this feature of the invention, means are provided for pivoting the trim tab about its pivotal axis in response to steering movement of the steering lever in an opposite direction for generating a hydrodynamic force from the trim tab upon the outboard drive tending to steer the outboard drive in the direction of movement of the steering lever. This means comprises a pair of control cables that are operatively connected to the steering lever and which extend from their point of operative connection in a direction generally longitudinally relative to the outboard drive.

Another feature of this invention is adapted to be embodied in a steering and throttle control arrangement for an outboard motor that is adapted to be affixed to the transom of an associated watercraft for steering movement about a generally vertically extending steering axis and carrying driven propulsion means at its lower end and a powering internal combustion engine having a throttle. A trim tab is pivotally carried by the outboard motor for movement about an axis that is parallel to the steering axis and which is adapted to be submerged in operation. In accordance with this feature of the invention, a steering lever is journaled by the outboard motor for rotation about a longitudinally extending axis and throttle control means are operatively connected between the lever and the engine throttle for operating the throttle in response to rotation of the lever about this axis. In addition, the lever is supported for pivotal movement relative to the outboard motor about a vertical pivotal axis. Control means operatively connect the steering lever to the trim tab for pivoting the trim tab about its pivot axis in response to pivotal movement of the steering lever about the vertical axis.

DETAILED DESCRIPTION OF THE PREFERRED EMBODIMENT

Figure 1:
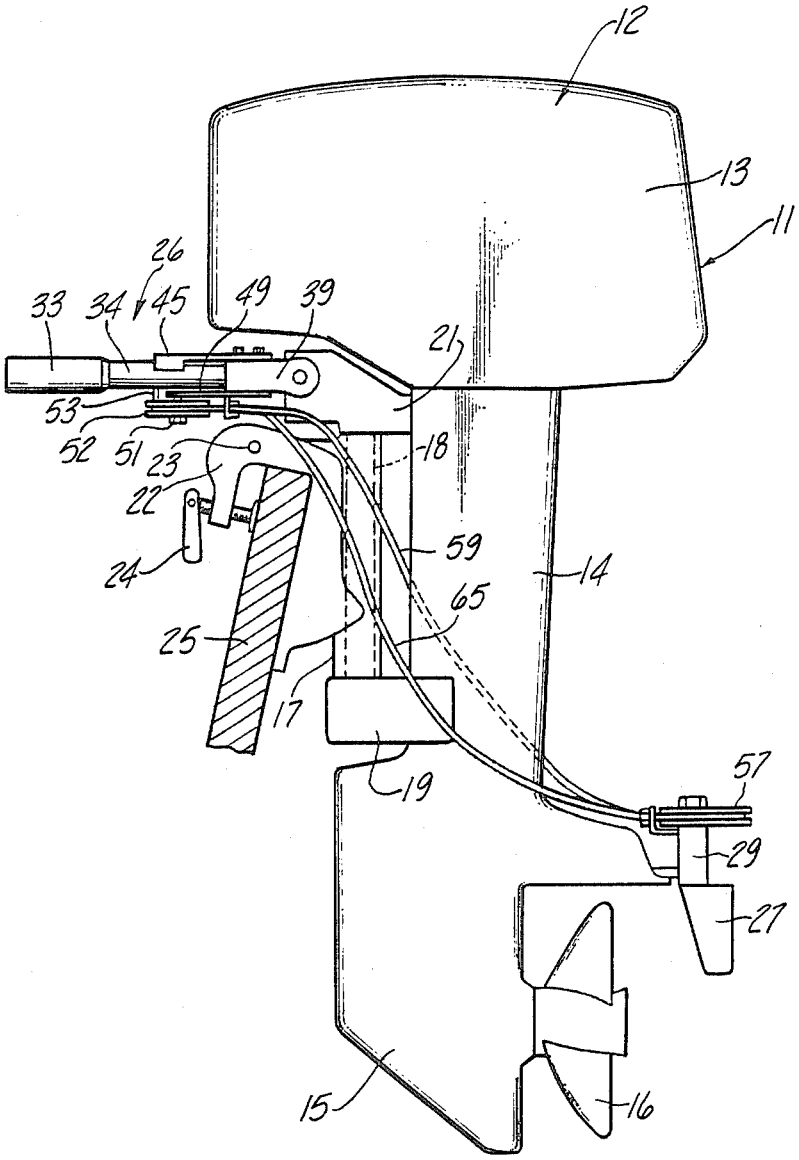
FIG. 1 if a side elevational view of an outboard motor constructed in accordance with an embodiment of the invention and attached to the transom of an associated watercraft.

Referring first to FIG. 1, an outboard motor constructed in accordance with an embodiment of the invention is identified generally by the reference numeral 11. The outboard motor 11 includes a power head, indicated generally by the reference numeral 12, which consists of an internal combustion engine of any known type having a speed controlling throttle (not shown) and a surrounding protective cowling 13. A drive shaft housing 14 depends from the power head 12 and contains a drive shaft (not shown) that is driven by the engine of the power head 12. A lower unit 15, in turn, is carried by the lower end of the drive shaft housing and contains a forward, neutral, reverse transmission that drives a propeller 16 in a known manner.

A swivel bracket 17 contains a steering shaft 18 and journals it for steering movement about a generally vertically extending steering axis. The steering shaft 18 is affixed in a suitable manner to the drive shaft housing 14 as by means of a lower bracket 19 and an upper bracket 21. The swivel bracket 17 is, in turn, pivotally connected to a clamping bracket 22 by means of a pivot pin 23 for pivotal movement of the outboard motor 11 about a generally horizontally extending tilt axis. The clamping bracket 22 has a clamping device 24 for affixing the outboard motor assembly 11 to a transom 25 of an associated watercraft.

The construction of the outboard motor 11 as thus far described is convention and, for that reason, no details of the specific components of the construction have been given.

Figure 4:
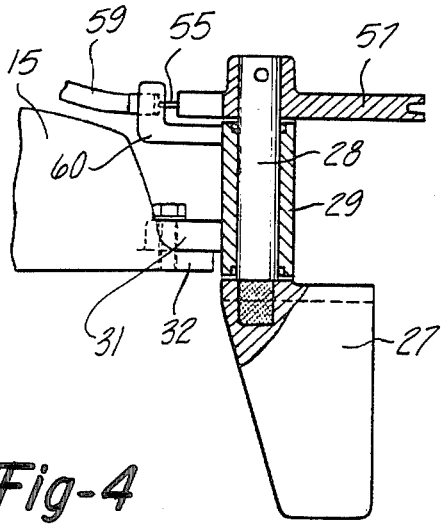
FIG. 4 is an enlarged side elevational view, with a portion broken away, showing the trim tab.
Figure 5:
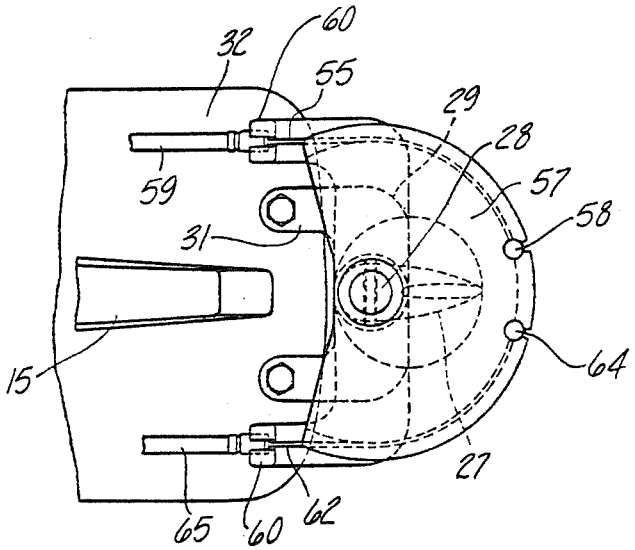
FIG. 5 is a top plan view of the trim tab mechanism as shown in FIG. 4.

Referring now to the remaining figures, a tiller or control lever assembly, indicated generally by the reference numberal 26 is provided for steering the outboard motor 11, controlling its speed and also for steering and for operating a trim tab device which is best shown in FIGS. 4 and 5. The trim tab device includes a trim tab 27 that is affixed to a shaft 28 which shaft is, in turn, journaled within a boss 29 that is affixed by a clamping arrangement 31 to a cavitation plate 32 of the lower unit 15. The boss 29 journals the shaft 28 and trim tab 27 for rotation about an axis that is parallel to and rearwardly displaced from the steering shaft axis 18. The manner in which the trim tab 27 is rotated about this axis will become apparent as the description proceeds.

Figure 2:
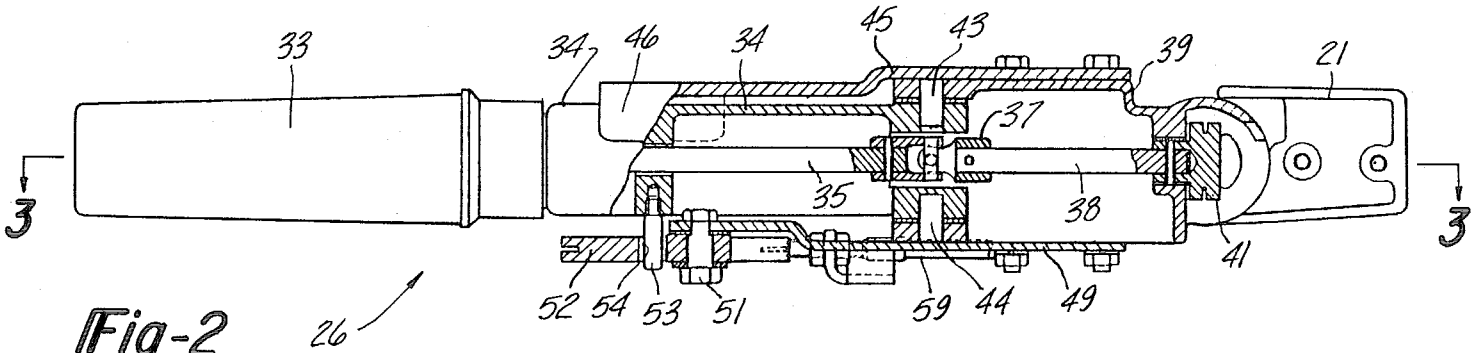
FIG. 2 is an enlarged side elevational view, with a portion broken away, showing the control lever mechanisms.
Figure 3:
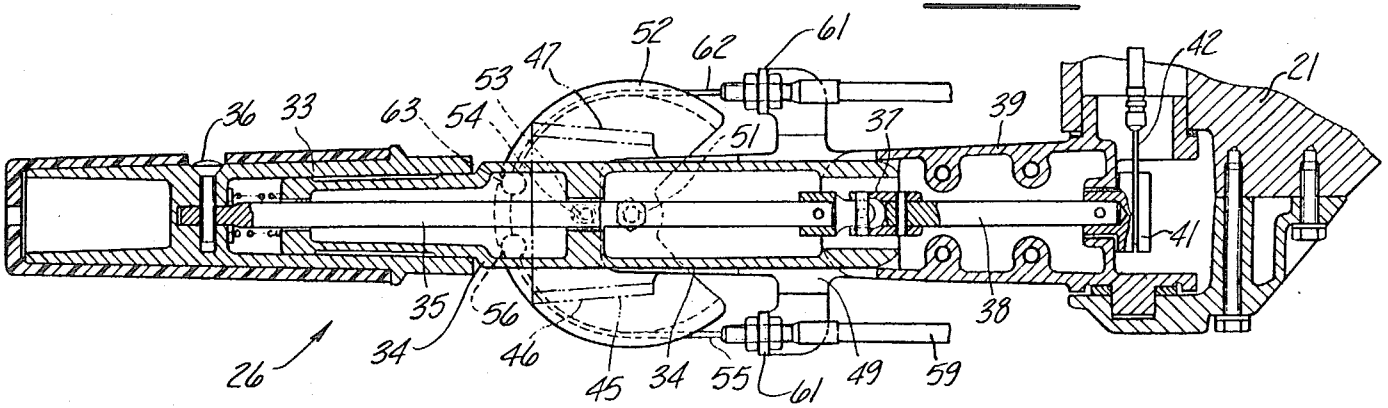
FIG. 3 is a cross-sectional view taken along the line 3—3 of FIG. 2.

Referring now primarily to FIGS. 2 and 3, the tiller or control lever assembly 26 includes a hand grip 33 that is rotatably journaled on a steering lever 34 for rotation about an axis that extends in a generally longitudinal direction relative to the lever 34. A first shaft 35 is pinned for rotation with the hand grip 33 by means of a pin 36. The opposite end of the shaft 35 is connected by means of a universal joint assembly 37 to a second shaft 38. The second shaft 38 is contained within a cavity formed in a fixed mounting bracket 39 which is, in turn, pivotally connected about a horizontal axis to the upper bracket 21 of the steering shaft 18. Hence, when the bracket 39 is rotated, the steering shaft 18 will be rotated about the swivel bracket 17 for steering of the motor 11 in a known manner.

A drum 41 is affixed to the inner end of the shaft 38 and has connected to it one end of a flexible transmitter 42. The opposite end of the flexible transmitter 42 is connected to the aforedescribed throttle of the engine that is contained within the power head 12 for operating the throttle in response to rotation of the hand grip 33.

The steering lever 34 is also pivotally carried by the bracket 39 by means of a pair of pivot pins 43 and 44 for pivotal movement about a generally vertically extending axis that is parallel to the steering axis of the steering shaft 18 and the axis of the shaft 28 of the trim tab 27. This axis is aligned with the universal joint 37 so that pivotal movement of the lever 34 relative to the bracket 39 will not affect the position of the throttle of the engine.

A further bracket 45 is affixed to the upper side of the bracket 39 and has a pair of angularly shaped depending lugs 46 and 47 that are adapted to be engaged with corresponding sides of the lever 34 so as to limit its degree of pivotal movement relative to the pins 43 and 44 and bracket 39. This construction, in effect, provides a lost motion connection between the lever 34 and the bracket 39.

A further bracket 49 is affixed to the underside of the bracket 19 and extends forwardly to a point where it supports a pivot shaft 51. A drum or pulley 52 is journaled on the pivot shaft 51 for rotation about an axis parallel to the axes of the pivot pins 43 and 44, the axis of the steering shaft 18 and the axis of the trim tab shaft 28. A pin 53 is affixed to the underside of the control lever 34 and extends into an opening 54 of the drum 52 for rotating the drum 52 in the same direction about the pivot pin 51 as the lever 34 pivots about the pivot pins 43 and 44. It should be noted that the pivotal axis about which the steering lever 34 moves (defined by the pivot pins 43 and 44) is spaced from the pin 53 a substantially greater distance than the distance between the pin 53 and the pivot shaft 51 of the pulley 52. As a result, a given amount of pivotal movement of the steering lever 34 about the pivot axis defined by the pins 43 and 44 will be transmitted into a substantially greater angular movement of the drum or pulley 52 about its pivot shaft 51 so as to amplify the amount of motion transmitted from the steering lever 34 to the drum or pulley 52.

One end of a first flexible transmitter 55 is affixed to the drum 52 as by means of a ferrule 56. The flexible transmitter 55 extends in a generally parallel direction relative to the steering lever 34 at the point where it leaves the drum 52 and runs along one side of the control lever assembly 26 to an area in proximity to the bracket 21. At this point, the flexible transmitter 55 crosses over the drive shaft housing 14 and extends downwardly where its other end is affixed to a corresponding drum 57 that is affixed to the upper end of the trim tab shaft 28. This end of the transmitter 55 is affixed to the drum 57 by means of a ferrule 58. The major portion of the length of the flexible transmitter 55 is encircled by a protective sheath 59 that has its lower end carried in a bracket 60 that is affixed to the bushing 29. The upper end of the protective sheath 59 is affixed relative to the bracket 33 by a suitable attaching portion 61.

In a similar manner, a second flexible transmitter 62 has one of its ends affixed to the drum 52 on the side opposite the transmitter 55 by means of a ferrule 63. This end of the flexible transmitter 62 also extends parallel to the control lever 34 and crosses over the drive shaft housing 14 adjacent the steering shaft 18 and is connected at its lower end to the opposite side of the trim tab drum 57 by means of a ferrule 64. The flexible transmitter 62 is also encircled by a protective sheath 65 which has its opposite ends carried by the brackets 60 and 61.

Figure 6:
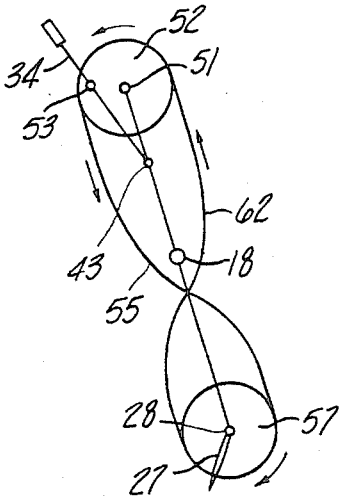
FIG. 6 is a partially schematic top plan view showing the operation of the trim tab in one steering direction.
Figure 7:
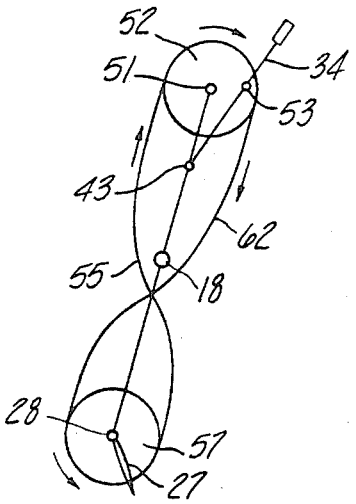
FIG. 7 is a schematic top plan view, in part similar to FIG. 6, showing the operation when steering in the opposite direction.

The operation of the device may be best understood by reference to FIGS. 6 and 7. FIG. 6 shows the arrangement when the boat or associated watercraft is being steered to the right. To accomplish this, the hand grip 33 and connected control lever 34 are moved to the left in a counterclockwise direction, as is typical with steering an outboard motor. However, the resistance of the motor 11 to initial steering movement causes the hand grip 33 and steering lever 34 to rotate relative to the bracket 39 about the axis defined by the pivot pins 43 and 44 due to this resistance. As a result of this rotation, the pin 53 through its cooperation with the opening 54 in the drum 52 rotates the drum 52 in a counterclockwise direction. This rotation puts a tensile force on the flexible transmitter 62 and a compressive force on the transmitter 55. Since the transmitters 62 and 55 cross over, the transmitter 62 will exert a force on the drum 57 that tends to rotate it and the trim tab 27 in a clockwise direction. As a result, there is a hydrodynamic force exerted on the trim tab 27 and, accordingly, the drive shaft housing 14 and lower unit 15 that tends to cause it to swing to the right or rotate in a counterclockwise direction. The relative rotation between the steering lever 34 and the bracket 39 will continue only until the lever 34 engages the lug 46 at which time the lever 34 and bracket 39 will be rotated together.

FIG. 7 illustrates the operation when steering the associated watercraft to the left. Under this condition, the steering lever 34 is rotated to the right in a clockwise direction so as to tension the flexible transmitter 55 and place a compressive force on the transmitter 62. Again because of the cross over of the transmitters 55 and 62, the trim tab 27 will be rotated in a counterclockwise direction and a hydrodynamic force will be exerted on the outboard motor tending to shift it in a clockwise direction so that the steering to the left will be facilitated.

Although an embodiment of the invention has been illustrated and described, various changes and modifications may be made without departing from the spirit and scope of the invention, as defined by the appended claims.

What is claimed is:

1. In a steering arrangement for a marine outboard drive adapted to be affixed to the transom of an associated watercraft for steering movement about a generally vertically extending steering axis and carrying driven propulsion means at its lower end, a trim tab pivotally carried by said outboard drive about an axis parallel to and rearwardly of said steering axis and adapted to be submerged in operation, and a steering lever extending forwardly from said outboard drive from said steering axis in a longitudinal direction and operably connected to said outboard drive for controlling steering movement about said steering axis, the improvement comprising means for pivoting said trim tab about its pivotal axis in a direction in response to steering movement of said steering lever in an opposite direction for generating a hydrodynamic force from said trim tab upon said outboard drive tending to steer said outboard drive in the direction of movement of said steering lever comprising a pair of flexible transmitters each affixed at one end to opposite sides of the steering lever forwardly of said steering axis and each having a portion extending from its point of operative connection longitudinally relative to the outboard drive to said steering axis, said steering lever being connected to said outboard drive by means including a lost motion connection defining a pivotal axis for said steering lever, a drum fixed relative to the outboard motor and supported for pivotal movement about a drum axis parallel to the pivotal axis of the steering lever and the axis of pivotal movement of the trim tab and means for rotating said drum about said drum axis upon relative movement of the steering lever relative to the outboard drive as afforded by the lost motion connection.

2. In a steering arrangement as set forth in claim 1 wherein the flexible transmitters cross over adjacent the outboard drive and are connected at their other ends to a drum that is affixed for rotation with the trim tab.

3. In a steering arrangement as set forth in claim 2 wherein the control lever is further rotatable about a longitudinally extending axis and wherein the outboard drive comprises an outboard motor having an internal combustion engine with throttle means, and means for operating said throttle means in response to rotation of said control lever about said longitudinal axis.

4. In a steering arrangement as set forth in claim 1 wherein the means for rotating the drum about the drum axis upon relative pivotal movement of the steering lever comprises a pin fixed to the steering lever and engageable with the drum at a point offset from the drum axis for rotating said drum upon relative movement of said steering lever relative to the outboard drive as afforded by the lost motion connection.

5. In a steering arrangement as set forth in claim 4 wherein the lost motion connection permits pivotal movement of the steering lever about a steering lever pivot axis, the member cooperating with the drum being affixed to the steering lever at a point further from the steering lever axis than the drum axis for amplifying the rotation of the drum about its axis in response to a given rotation of the steering lever about its pivot axis.

* * * * *